US007067753B1

(12) United States Patent
Cheng

(10) Patent No.: US 7,067,753 B1
(45) Date of Patent: Jun. 27, 2006

(54) KEYPAD LIGHT GUIDE

(75) Inventor: Wen-Feng Cheng, Tu-Cheng (TW)

(73) Assignee: HON HAI Precision Industry Co., LTD, Tu-cheng (TW)

( * ) Notice: Subject to any disclaimer, the term of this patent is extended or adjusted under 35 U.S.C. 154(b) by 0 days.

(21) Appl. No.: 11/353,503

(22) Filed: Feb. 14, 2006

(30) Foreign Application Priority Data

Aug. 5, 2005 (CN) ..... 2005 1 0036410

(51) Int. Cl.
*H01H 9/18* (2006.01)

(52) U.S. Cl. ..... 200/310; 200/314; 200/317

(58) Field of Classification Search ..... 200/310, 200/314, 317; 341/22; 345/168–176; 362/23–31, 362/85, 109, 800
See application file for complete search history.

(56) References Cited

U.S. PATENT DOCUMENTS 4,670,633 A * 6/1987 Kaiwa et al. ..... 200/314
4,851,624 A * 7/1989 Chestnut et al. ..... 200/317
5,053,928 A 10/1991 Pasco
5,083,240 A * 1/1992 Pasco ..... 362/26
5,128,842 A * 7/1992 Kenmochi ..... 362/95
5,711,588 A * 1/1998 Rudisill ..... 362/30
6,834,973 B1 * 12/2004 Ohkawa ..... 362/617
6,909,063 B1 * 6/2005 Nam ..... 200/406

* cited by examiner

*Primary Examiner*—Michael A. Friedhofer
(74) *Attorney, Agent, or Firm*—Morris, Manning & Martin LLP; Tim Tingkang Xia, Esq.

(57) ABSTRACT

A light guide for illuminating keys of a keyboard or keypad of a portable electronic device includes an array of apertures, at least one groove and at least a protrusion. The apertures are defined in the light guide and are configured to illuminate the keys via at least a light source. The groove is disposed in one end of the light guide for receiving light from the light source. The light guide can provide a desired uniform illumination by means of fewer light sources, and can improve optical uniformity by eliminating the bright areas occurring adjacent to the light sources.

16 Claims, 3 Drawing Sheets

KEYPAD LIGHT GUIDE

TECHNICAL FIELD

The present invention relates to a light guide for illuminating keys of a keyboard or keypad.

BACKGROUND

Portable electronic devices usually include keyboards or keypads so that information may be input. When portable electronic devices are used in the dark, the keys need to be illuminated. Each individual key may be illuminated by a respective light source located directly behind the key. This arrangement is, however, very expensive since a separate light source is required for each key. Also, without carefully designed diffusers in or behind the keys, unsightly bright spots may be seen through the keys coinciding with the light source.

A more economical approach utilizes fewer light sources with the light being directed toward the keys with the aid of a light guide in the form of a transparent plate. A known light guide includes an array of apertures. A portion of each key depends or extends into the corresponding aperture so that light can be directed into the key from the light guide. Thus, some of the light is directed toward the apertures and so illuminates the keys. A drawback with this arrangement is that it does not give uniform illumination, because the lighting effect deteriorates toward the edges of the keyboard or keypad and other locations further away from the light sources.

Referring to FIG. 5, a conventional keypad light guide 50 is shown. The light guide 50 is for a mobile phone, and defines a regular array of apertures 52 which correspond to shaped keys 53. Four prismatic indentations 58 are defined among the apertures 52. Each lens 57 is disposed under each indentation 58 in one side of the light guide 50, and is formed integrally with the light guide 50. Light is introduced into the light guide 50 from distributed light sources (not shown) such as light emitting diodes (LEDs) under each corresponding prismatic indentation 58. Each lens 57 serves to collimate the majority of light from its associated light source into a light beam through the light guide 50. The indentations 58 are arranged for reflecting light in a localized path substantially surrounding an area of each shaped key 53.

Although the design of the light guide 50 may illuminate the keys 53, the light guide 50 requires more than one light source that is an added cost and consumes more power. In addition, brightness areas may appear when the light sources are disposed adjacent to the light guide 50, thereby the optical uniformity of the light guide 50 is decreased.

What is needed, therefore, is a new light guide which can provide a desired uniform illumination by means of fewer light sources, and can improve optical uniformity by eliminating the bright areas adjacent to light sources.

SUMMARY

A light guide for illuminating keys of a keyboard or keypad of a portable electronic device according to a preferred embodiment includes an array of apertures defined therein, and being configured to illuminate the keys via at least a light source; at least one groove disposed in one end of the light guide, for receiving light from the light source; and at least a protrusion defined in a bottom surface of the groove and facing the light source.

Other advantages and novel features will become more apparent from the following detailed description of the preferred embodiments, when taken in conjunction with the accompanying drawings.

BRIEF DESCRIPTION OF THE DRAWINGS

Many aspects of the keypad light guide can be better understood with reference to the following drawings. The components in the drawings are not necessarily to scale, the emphasis instead being placed upon clearly illustrating the principles of the present device. Moreover, in the drawings, like reference numerals designate corresponding parts throughout the several views.

DETAILED DESCRIPTION OF THE PREFERRED EMBODIMENTS

Figure 1:
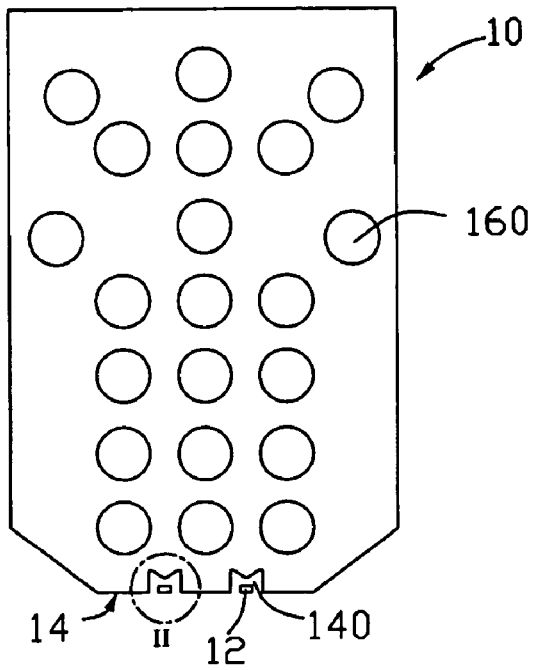
FIG. 1 is a schematic, top plan view of a keypad light guide according to a first preferred embodiment.

Referring now to the drawings in detail, FIG. 1 shows a transparent plate-like light guide 10 having a generally rectangular outline in accordance with a first embodiment of the present invention. The light guide 10 can be applied in an electronic device such as a mobile phone.

The light guide 10 has a generally grid-like configuration, and includes an array of apertures 160 substantially arranged in seven rows and three columns. The apertures 160 correspond to indicators like keys (not shown) of the device. When the keys are located within the apertures 160, light can readily be directed into the keys by the light guide 10. The light guide 10 has two grooves 140 on an end surface 14 thereof. A shape of each groove 140 is configured to be generally rectangular. Each groove 140 has a protrusion 142 disposed on a bottom surface 141 thereof to be used as a light-scatter means. A shape of each protrusion 142 is configured to be a V-shaped. Two light sources 12, such as light emitting diodes (LEDs), are respectively disposed near the V-shaped protrusion 142 of the grooves 140. A thickness of the light guide 10 is approximately in the range from 0.8 to 1.2 millimeter.

Figure 2:
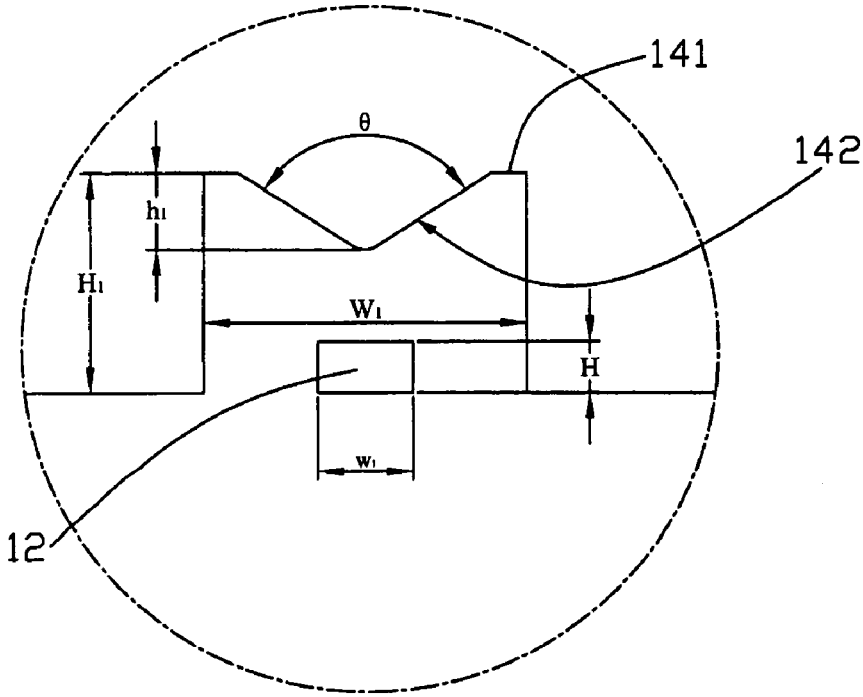
FIG. 2 is an enlarged view of a circled portion II of FIG. 1.

Referring to FIG. 2, the size of each groove 140 is configured to be larger than that of the LED 12 for completely accommodating the LED 12. Therefore, the size of the grooves 140 and the LEDs 12 is determined with a formula: $H_1>H+h_1$, $W_1>w_1$, wherein $H_1$, H, and $h_1$ respectively represent heights of the groove 140, the LED 12, and the V-shaped protrusion 142; $W_1$ and $w_1$ respectively represent widths of the groove 140 and the LED 12. In illustrated embodiment, the preferred height $H_1$ of the groove 140 is advantageously configured to be equal to $(H+h_1+h_0)$, wherein $h_0$ is a distance from the LED 12 to a vertex of the V-shaped protrusion 142, and is approximately in the range from 0.2 to 0.5 millimeters. The preferred width $W_1$ of the groove 140 is advantageously configured to be equal to $(w_1+2)$ millimeters.

Referring also to FIG. 2, a vertex angle of the V-shaped protrusion 142 is defined as "θ". The height of the V-shaped protrusion 142 is determined by the formula: $h_1=(W_1/2)/\tan$ ($\theta/2$). A preferred angle of the V-shaped protrusion 142 is approximately in a range of 90 to 160 degrees. $W_1$ is known. Accordingly, a value of $h_1$ is determined.

Because two LEDs 12 are respectively disposed in the two grooves 140 and adjacent to the V-shaped protrusions 142, light beams emitted from the LEDs 12 can be substantially scattered by the V-shaped protrusions 142, thereby improving uniform illumination for eliminating bright areas formed adjacent and/or proximal to the end surface 14 of the light guide 10.

Figure 3:
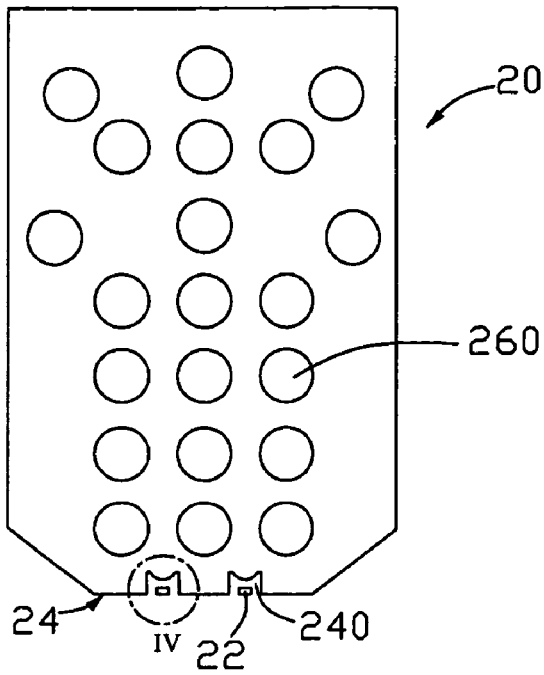
FIG. 3 is a schematic, top plan view of a keypad light guide according to a second preferred embodiment.
Figure 4:
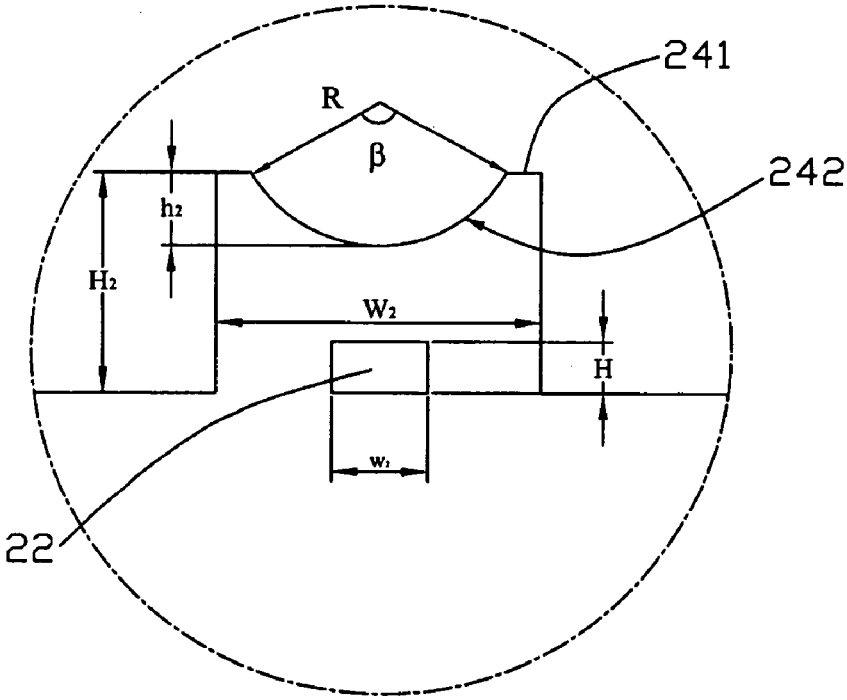
FIG. 4 is an enlarged view of a circled portion IV of FIG. 3.
Figure 5:
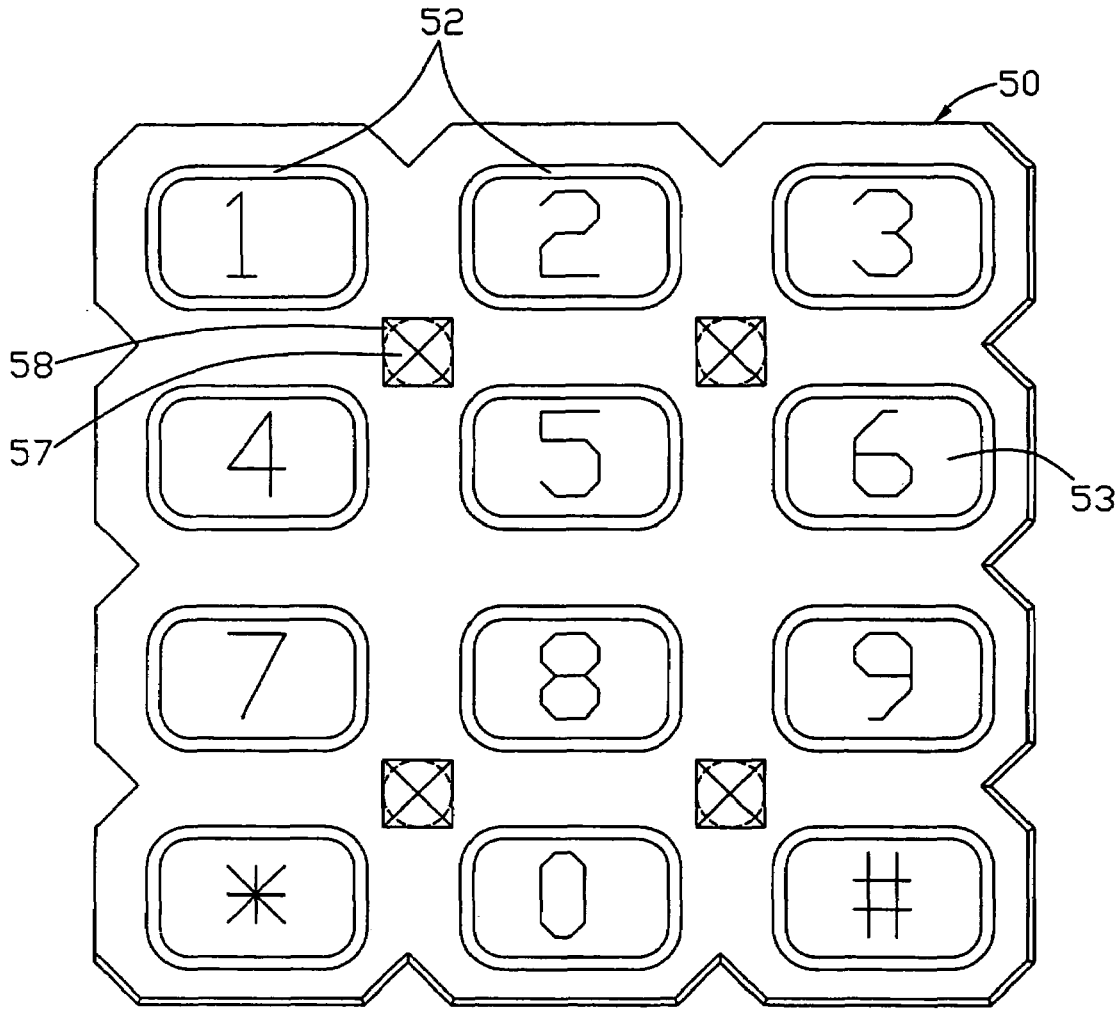
FIG. 5 (PRIOR ART)
FIG. 5 is a schematic, isometric view of a conventional keypad light guide.

Referring to FIGS. 3 and 4, a light guide 20 in accordance with the second preferred embodiment. The light guide 20 includes an array of apertures 260 defined therein; two grooves 240 disposed in one end surface 24 thereof for accommodating two LEDs 22 respectively; and two protrusions 242 respectively defined in a bottom surface 241 of the two grooves 240. The light guide 20 is similar to that of the light guide 10, except that the protrusion 242 is different from the V-shaped protrusion 142 of the light guide 10.

A shape of the protrusion 242 is configured to be arcuate. The size of the grooves 240 and the LED 22 is determined with a formula: $H_2>H+h_2$, $W_2>w_2$, wherein $H_2$, H and $h_2$ respectively represent heights of the groove 240, the LED 22, and the arcuate protrusion 242; and $W_2$, $w_2$ respectively represent widths of the groove 240 and the LED 22. In this embodiment, the preferred height $H_2$ of the groove 240 is advantageously configured to be equal to $(H_2+h_2+h_0)$, wherein $h_0$ is a distance from the LED 22 to a vertex of the arcuate protrusion 242, and is approximately in the range from 0.2 to 0.5 millimeters.

Referring also to FIG. 4, a radius of the arcuate protrusion 242 is represented as "R", and an angle subtended by the arcuate protrusion 242 is represented as "β". The height of the arcuate protrusion 242 is determined with a formula: $h_2=R(1-\cos(\beta/2))$. A preferred value of the angle "β" is approximately in a range of 90 to 160 degrees. Because the radius R is known, a value of $h_2$ can be determined. The radius R can be configured to be about in the range from 0.5 $W_2$ to 5 $W_2$.

The arcuate protrusions 242 can also scatter the light beams emitted from the LEDs 22 for obtaining a good optical uniformity for eliminating bright areas formed adjacent and/or proximate to the end surface 24 of the light guide 20.

It is to be understood that a plurality of protrusions can be arranged periodically on the bottom surface of each groove of the present light guide, for further improving the optical uniformity of the light guide. It is also to be understood that four corners of the grooves defined on an end surface of the light guide can be configured to be rounded corners.

It is noted that a material of the present keypad light guide, which is suitably formed by injection molding, may be any suitable optical quality transparent material such as polymethyl methacrylate (PMMA), polycarbonate (PC), and a combination thereof.

As described above, the preferred embodiments provide a light guide yielding a desired uniform light by means of fewer light sources, thus requiring little power.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A light guide for illuminating keys of a keyboard or keypad of a portable electronic device, comprising:

an array of apertures defined therein, and being configured to illuminate the keys via at least a light source;

at least one groove disposed in one end surface of the light guide, for receiving light from the light source; and at least a protrusion defined in a bottom surface of the at least one groove.

2. The light guide according to claims 1, wherein the at least one groove is configured to be rectangular.

3. The light guide according to claim 1, wherein the protrusion is selectively configured to be one of a V-shaped protrusion and an arcuate protrusion.

4. The light guide according to claim 3, wherein a vertex angle of the V-shaped protrusion is approximately in the range from 90 to 160 degrees.

5. The light guide according to claim 3, wherein an arc angle of the arcuate protrusion is approximately in the range from 90 to 160 degrees.

6. The light guide according to claim 3, wherein a radius of the arcuate protrusion is approximately in the range from 0.5 W to 5 W, and W is a width of the at least one groove.

7. The light guide according to claim 1, wherein a height $H_1$ of the at least one groove is determined by a formula: $H_1>H+h_1$, H is a height of the light source and $h_1$ is a height of the protrusion.

8. The light guide according to claim 7, wherein a height $H_1$ of the at least one groove is determined by a formula: $H_1=H+h_1+h_0$, H is a height of the light source, $h_1$ is a height of the protrusion, and $h_0$ is approximately in the range from 0.2 to 0.5 millimeter.

9. The light guide according to claim 1, wherein the at least one groove includes four rounded corners.

10. The light guide according to claim 1, wherein a thickness of the light guide is approximately in the range from 0.8 to 1.2 millimeter.

11. The light guide according to claim 1, wherein the light guide is comprised of a material selected from a group consisting of polymethyl methacrylate, polycarbonate, and a combination thereof.

12. An electronic device comprising:

a plurality of indicators movably installable along a side of said electronic device and user-accessible at said side of said electronic device;

a light guide installable in said electronic device beside said plurality of indicators and extendable along said side of said electronic device, said light guide comprising a plurality of apertures corresponding to said plurality of indicators respectively so as to allow each of said plurality of indicators extending partially into a corresponding one of said plurality of apertures; and at least one light source installable in a neighboring area of said plurality of indicators along said side of said electronic device, and being located beside said light guide and arranged to be substantially surrounded by said light guide, a light-scatter means formed between said at least one light source and said light guide so as to dispersibly transmit light from said at least one light source into said light guide while said light guide subsequently transmits said light toward said each of said plurality of indicators along directions substantially parallel to said side of said electronic device.

13. The electronic device according to claim 12, wherein said light-scatter means is a protrusion integrally extending from said light guide toward said at least one light source.

14. The electronic device according to claim 12, wherein each of said at least one light source is received by a corresponding groove formed at said light guide and said light-scatter means is formed inside said groove next to said each of said at least one light source.

15. An electronic device comprising:

a plurality of indicators installable along a side of said electronic device and user-accessible at said side of said electronic device;

a light guide installable beside said plurality of indicators along a plane defined next to said side of said electronic device and parallel thereto, said light guide occupying an area in said plane including projecting areas of said plurality of indicators on said plane and being light-communicable with each of said plurality of indicators; and at least one light source installable in said plane beside said light guide and capable of emitting light therefrom toward a light-scatter means for altering paths of said light before said light enters said light guide to illuminate said each of said plurality of indicators.

16. The electronic device according to claim 15, wherein said light-scatter means is a protrusion integrally extending from said light guide toward said at least one light source.

* * * * *